US009146495B2

(12) United States Patent
Takahashi

(10) Patent No.: US 9,146,495 B2
(45) Date of Patent: Sep. 29, 2015

(54) DEVELOPER SUPPLY DEVICE HAVING DEVELOPER REGULATION PORTION TO REGULATE AMOUNT OF DEVELOPER ON BRUSH LAYER

(71) Applicant: Brother Kogyo Kabushiki Kaisha, Nagoya-shi, Aichi-ken (JP)

(72) Inventor: Keisuke Takahashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/315,746

(22) Filed: Jun. 26, 2014

(65) Prior Publication Data

US 2014/0308056 A1 Oct. 16, 2014

Related U.S. Application Data

(63) Continuation-in-part of application No. PCT/JP2012/074231, filed on Sep. 21, 2012.

(30) Foreign Application Priority Data

Dec. 28, 2011 (JP) ..... 2011-287118

(51) Int. Cl.
*G03G 15/08* (2006.01)

(52) U.S. Cl.
CPC ..... *G03G 15/0812* (2013.01); *G03G 15/0818* (2013.01)

(58) Field of Classification Search
CPC ..... G03G 15/0805; G03G 15/0812
USPC ..... 399/284, 287
See application file for complete search history.

(56) References Cited

U.S. PATENT DOCUMENTS 3,682,678 A * 8/1972 Moradzadeh et al. ..... 399/287
4,407,228 A 10/1983 Takano et al.
5,293,181 A 3/1994 Iwao et al.

FOREIGN PATENT DOCUMENTS

JP S57-64266 A 4/1982
JP S57-100753 A 6/1982

(Continued)

OTHER PUBLICATIONS

International Search Report issued in International Application No. PCT/JP2012/074231 mailed Oct. 16, 2012.

(Continued)

*Primary Examiner* — William J Royer
(74) *Attorney, Agent, or Firm* — Banner & Witcoff, Ltd.

(57) ABSTRACT

In a developer supply device, a developer carrying portion has a roller main body and a brush layer having flexible fibrous members. A casing includes a developer reservoir portion therein and is formed with an opening portion. The casing rotatably supports the developer carrying portion while the brush layer is exposed externally at the opening portion and opposes a supply target. A developer regulation portion regulates an amount of developer on the brush layer. The developer regulation portion includes a main part and a regulation part. The main part is fixed to the casing, has a plate portion, and extends from one end to another end in an extending direction. The regulation part is connected to the other end. The regulation part enters into the brush layer toward a central rotational axis. A prescribed rotational direction at the regulation part is substantially opposite to the extending direction.

4 Claims, 3 Drawing Sheets

(56) References Cited

FOREIGN PATENT DOCUMENTS

| | | | |
|---|---|---|---|
| JP | 57-108870 | A | 7/1982 |
| JP | S58-57156 | A | 4/1983 |
| JP | S58-58568 | A | 4/1983 |
| JP | H04-317084 | A | 11/1992 |
| JP | H10-207217 | A | 8/1998 |
| JP | H11-174838 | A | 7/1999 |
| JP | 2010-276720 | A | 12/2010 |

OTHER PUBLICATIONS

Jul. 10, 2014—(WO) International Preliminary Report on Patentability and Written Opinion—App PCT/JP2012/074231, Eng Tran.
Aug. 11, 2015—(JP) Office Action—App 2011-287118, Eng Tran.

* cited by examiner

DEVELOPER SUPPLY DEVICE HAVING DEVELOPER REGULATION PORTION TO REGULATE AMOUNT OF DEVELOPER ON BRUSH LAYER

CROSS REFERENCE TO RELATED APPLICATION

This application claims priority from Japanese Patent Application 2011-287118 filed Dec. 28, 2011. This application is also a continuation-in-part of International Application No. PCT/JP2012/074231 filed Sep. 21, 2012 in Japan Patent Office as a Receiving Office. The contents of these applications are incorporated herein by reference.

TECHNICAL FIELD

The present invention relates to a developer supply device that is adapted to supply a developer in powder form (i.e. a dry developer) to a supply target.

BACKGROUND

One such example of these devices is known. Please refer to Patent Documents 1 through 5). These devices use a so-called "brush roller" as a developer carrier (i.e. as a development roller).

Patent document 1: Japanese Patent Application Publication No. S57-64266

Patent document 2: Japanese Patent Application Publication No. S57-100753

Patent document 3: Japanese Patent Application Publication No. S57-108870

Patent document 4: Japanese Patent Application Publication No. S58-57156

Patent document 5: Japanese Patent Application Publication No. 2010-276720

SUMMARY

With the prior art devices described above, it has been difficult for the brush roller to carry the developer thereon in a favorable manner. For example, the developer tends to become clogged into the brush nap of the brush roller. If this kind of developer clogging occurs, then white background fogging appears in the created image.

The present invention is provided in order to deal with this problem. The objective of the present invention is, in a developer supply device that employs a brush roller as a developer carrier, to provide a structure that is capable of satisfactorily carrying the developer upon the brush roller.

In order to attain the above and other objects, the invention provides a developer supply device. The developer supply device may include a developer carrying portion, a casing, and a developer regulation portion. The developer carrying portion may be configured to supply developer in powder form to a supply target and capable of rotating in a prescribed rotational direction about a central rotational axis. The developer carrying portion may have a roller main body and a brush layer. The roller main body may have an outer surface. The brush layer may have a plurality of flexible fibrous members implanted in the outer surface. The brush layer may be configured to carry the developer. The casing may have a box shaped member. The box shaped member may include a developer reservoir portion therein and is formed with an opening portion along the central rotational axis. The developer reservoir portion reserves the developer. The casing may rotatably support the developer carrying portion while the brush layer is exposed to exterior at the opening portion and opposes the supply target. The developer regulation portion may be configured to regulate an amount of the developer on the brush layer by scraping off a part of the developer temporarily carried on the brush layer. The developer regulation portion may include a main part and a regulation part. The main part may be fixed to the casing, have a plate portion, and extend from one end part to another end part in an extending direction. The regulation part may be connected to the other end part. The regulation part may enter into the brush layer by protruding toward the central rotational axis. The prescribed rotational direction at the regulation part may be substantially opposite to the extending direction.

DETAILED DESCRIPTION

In the following, embodiments of the present invention will be described with reference to the drawings.

<Structure of a Toner Supply Device>

Figure 1:
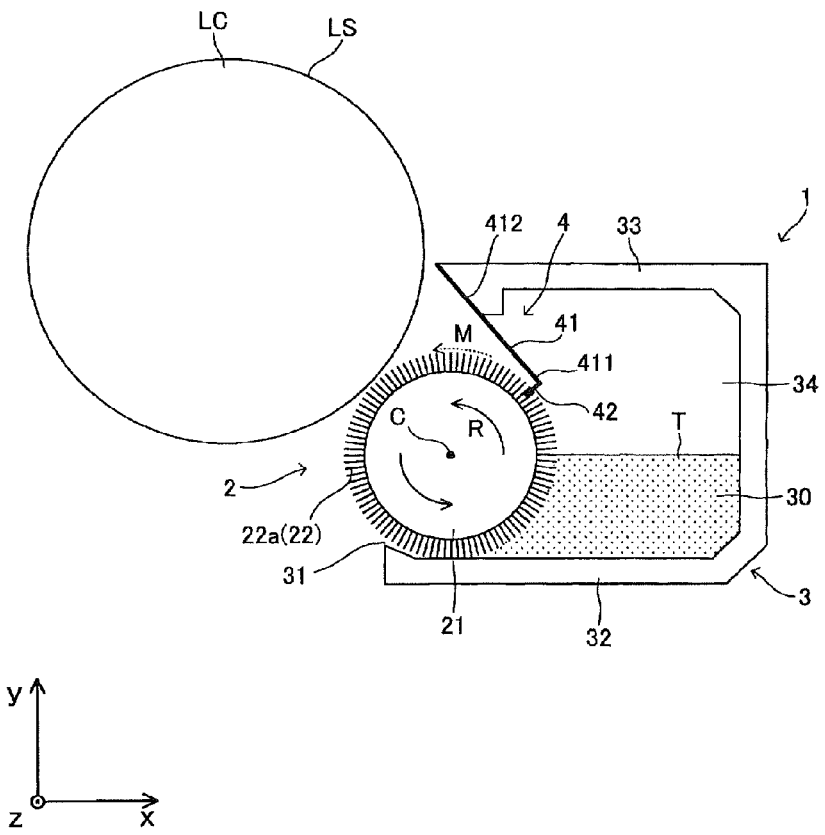
FIG. 1 is a schematic view showing a configuration of a toner supply device according to an embodiment of the present invention.

FIG. 1 shows the general structure of a toner supply device 1 according to an embodiment of the present invention. As shown in FIG. 1, the toner supply device 1 of the embodiment supplies a toner T to the circumferential surface of a photosensitive drum LC, which is a supply target. The toner T is a non-magnetic powder type single component developer. Specifically, the toner T is supplied to an electrostatic latent image carrying surface LS of the photosensitive drum LC, upon which a latent electrostatic image is formed. Moreover, the toner supply device 1 includes a developing roller 2, a casing 3, and a regulation blade 4.

The developing roller 2 functions as a developer transport member, and is a rotating body so as to be rotationally driven in a predetermined rotational direction R (in FIG. 1, the anticlockwise direction) around a central axis C as a center. The developing roller 2 is a so-called "brush roller", and has a known structure similar to the structures disclosed in Japanese Patent Application Publication S57-64266, Japanese Patent Application Publication S57-108870, and Japanese Patent Application Publication S58-57156. In concrete terms, the developing roller 2 includes a roller main body 21, and a brush layer 22. The roller main body 21 has a cylindrical shape. The brush layer 22 has a large number of flexible fibrous members 22*a*. The flexible fibrous members 22*a* are implanted in the outer cylindrical surface of the roller main body 21. The brush layer 22 carries toner T thereon.

The casing 3 is a box shaped member having a toner reservoir portion 30 therein (i.e. a space for storing toner T for being transported by the brush layer 22). The casing 3 includes a bottom plate 32, a top plate 33, and a pair of side plates 34. An opening portion 31 is formed in the casing 3 and extends along the central axis C. In concrete terms, the opening portion 31 in the casing 3 is defined by the edge of the bottom plate 32 that faces toward the photosensitive drum LC, the edge of the top plate 33 that faces toward the photosensitive drum LC, and the edges of the pair of side plates 34 that face toward the photosensitive drum LC. The casing 3 rotatably supports the developing roller 2 while the brush layer 22 is exposed to the exterior at the opening portion 31 and opposes the photosensitive drum LC.

The regulation blade 4 regulates an amount of toner T carried by the brush layer 22 by scraping off a portion of the toner T temporarily carried upon the brush layer 22, and thus serves as a carried developer amount regulation member. Specifically, the regulation blade 4 is a thin plate shaped member that is made from stainless steel and extends along the central axis C. The regulation blade 4 includes a main blade portion 41 and a regulation portion 42. In other words, the main blade portion 41 and the regulation portion 42 are integrally formed from a single thin plate without seamed portion.

The main blade portion 41 is formed in the shape of a flat plate, except for its end portion 411. A base end portion 412 of the main blade portion 41 is fixed to the top plate 33 of the casing 3. In other words, the base end portion 412 of the main blade portion 41 is fixed to the edge of the opening portion 31. This edge of the opening portion 31 is positioned at the upstream side of the brush layer 22, which is exposed towards the photosensitive drum LC, in a moving direction M of the rotating developing roller 2 (shown by the broken arrow in FIG. 1). And, taking the base end portion 412 as a reference, the main blade portion 41 is provided so as to extend from the downstream side of the direction of rotation of the developing roller 2 towards its upstream side (in other words, in the direction opposite to the moving direction M described above).

Figure 2:
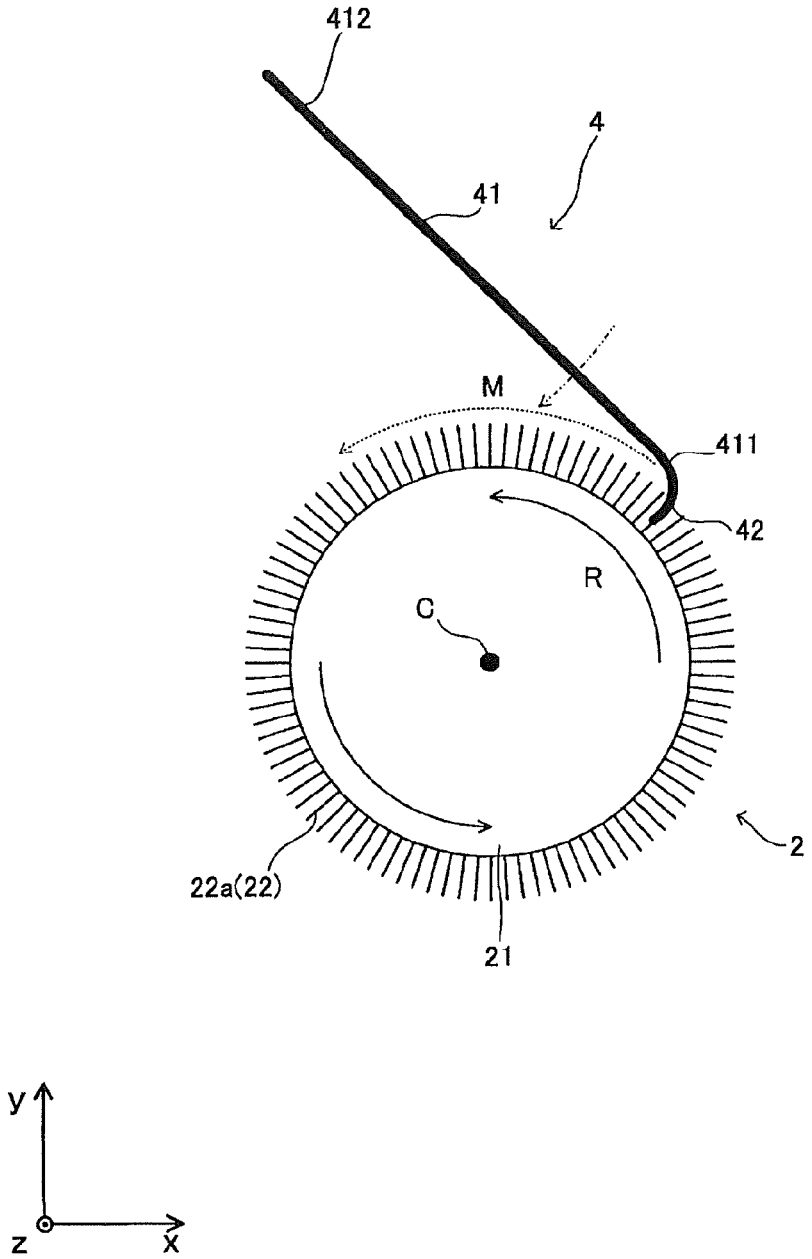
FIG. 2 is an enlarged view of periphery of a developing roller and regulation blade shown in FIG. 1.

FIG. 2 is an enlarged view showing the regulation blade 4 shown in FIG. 1 and the vicinity of the developing roller 2. Referring to FIG. 2, the regulation portion 42 is provided so as to project towards the central axis C from the end portion 411 of the main blade portion 41, and thus enters into the brush layer 22. Moreover, the regulation portion 42 is provided so as to curve towards the developing roller 2 from the end portion 411 of the main blade portion 41. In concrete terms, a radiused curve is formed over the portion between the end portion 411 of the main blade portion 41 and the regulation portion 42.

Figure 3:
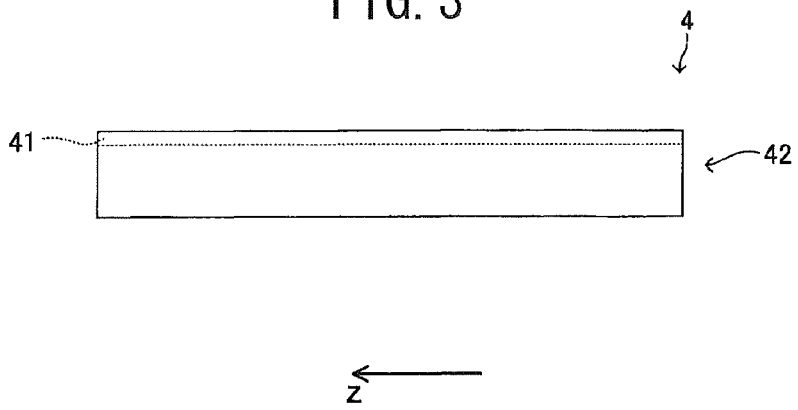
FIG. 3 is an enlarged view of a regulation portion of the regulation blade shown in FIGS. 1 and 2 with respect to a direction of an extending direction of a main blade portion.

FIG. 3 is an enlarged view illustrating an example of the regulation portion 42 of the regulation blade 4 shown in FIGS. 1 and 2, with respect to a direction orthogonal to an extending direction of the main blade portion 41.

As shown in FIG. 3, in the regulation portion 42 of the regulation blade 4, the portion that projects towards the central axis C or the brush layer 22 (refer to FIGS. 1 and 2) has a flattened shape. In other words, the lower edge of the regulation portion 42 of FIG. 3 is shaped to be flat. In this case, the regulation portion 42 best fits against the hairs of the brush. According to this shape for the regulation blade 4, the toner T can be satisfactorily scraped off from within the brush layer 22.

<Operation and Beneficial Effects>

As described above, in this embodiment, the regulation blade 4 is arranged from the opposite direction (i.e. the facing direction) with respect to the rotational direction of the developing roller 2 (i.e. the moving direction of the brush layer 22), so as to contact thereto. Further, the regulation portion 42, which is the end portion of the regulation blade 4 in the extending direction of the regulation blade 4, is curved so as to enter into the brush layer 22. Accordingly, portions of the toner T carried in the brush layer 22 (in particular some of the portions between neighboring fibrous members 22*a*) are scraped off satisfactorily by the regulation portion 42 of the regulation blade 4 entering satisfactorily into the brush layer 22. Accordingly, the developing roller 2 can satisfactorily carry the amount of toner T required for development.

In particular, according to the structure of this embodiment, a radiused portion is formed over the portion between the end portion 411 of the main blade portion 41 and the regulation portion 42. Due to this if, during the moving of the brush layer 22 as the developing roller 2 rotates, rotational resistance is generated at the portion where the developing roller 2 and the regulation blade 4 are in contact (the resistance is larger, as the amount of clogging of toner T within the brush layer 22 is larger), then a force making the regulation portion 42 enter into the brush layer 22 (this force is shown in FIG. 2 by the double dotted broken line arrow) increasingly acts on the regulation blade 4.

Thus, according to the structure of this embodiment, the occurrence of clogging of the toner T within the brush layer 22 (in particular in the vicinity of the lower end portions of the fibrous members 22*a*, in other words near their bases) can be satisfactorily suppressed, so that the developing roller 2, which is a brush roller, can be made to carry the toner T satisfactorily.

<Modifications>

The embodiment described above is only a description of a representative embodiment of the present invention that, at the time point of filing of the present application, the applicant currently considers to be preferred. Thus, in principle, the present invention is not to be considered as being limited in any way by the embodiment described above. Accordingly it is a matter of course that various changes may be made to the embodiment described above, provided that the essential portion of the present invention is not altered.

In the present invention, the target for supply is not limited to being a photosensitive drum. For example, the present invention can also be satisfactorily applied to a photosensitive component that is shaped as a flat plate or as an endless belt. Or the present invention can also be appropriately applied to an image forming device that uses some method other than the method for electronic photography described above (for example, a toner jet method, an ion flow method, or a multi-stylus electrode method or the like in which no photosensitive component is employed). In this case, an image formation medium such as paper and the like or an aperture electrode (refer to U.S. Pat. No. 5,293,181) or the like will correspond to the supply target.

The material for the regulation blade is not limited to being metallic. For example, the regulation blade 4 may also be made from synthetic resin. In this case, in order to prevent buildup of electrostatic charge, it is appropriate to employ an electrically conductive or a partially electrically conductive synthetic resin as the material for the regulation blade 4.

Figure 4:
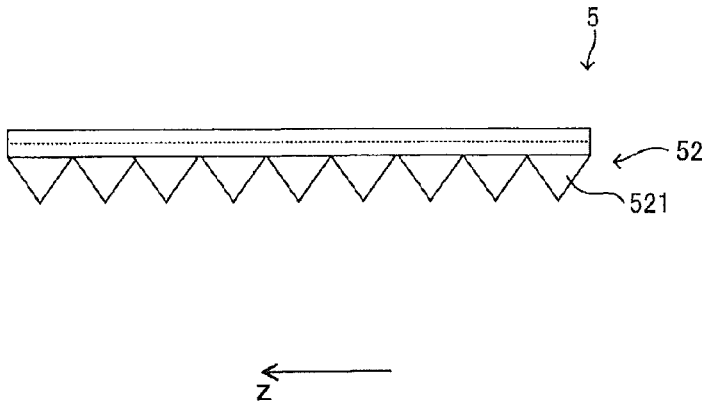
FIG. 4 is an enlarged view of a regulation portion of a regulation blade according to a modification.
Figure 5:
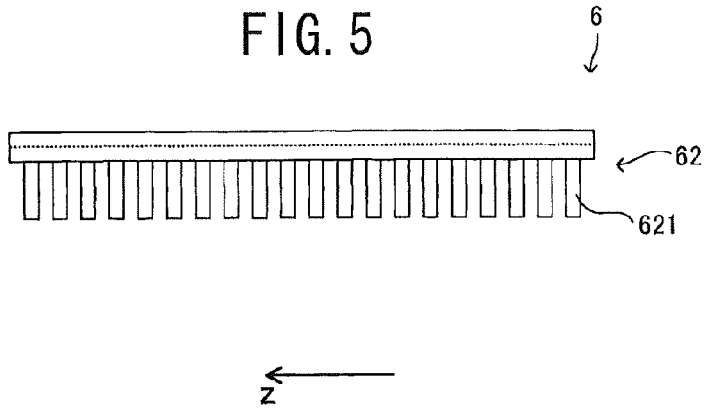
FIG. 5 is an enlarged view of a regulation portion of a regulation blade according to another modification.

FIGS. 4 and 5 show modifications of the regulation blade 4 shown in FIG. 3. As shown in FIGS. 4 and 5, regulation portions 52, 62 of regulation blades 5, 6 may have a large number of projections 521, 621 that are provided so as to project toward the central axis C or the brush layer 22 (refer to FIGS. 1 and 2). In this case, as shown in FIG. 4, the large number of projections 521 may be formed as teeth; or, as shown in FIG. 5, the large number of projections 621 may be formed in the shape of a comb. According to these structures, the occurrence of clogging of the toner T within the brush layer 22 can be suppressed (in particular in the vicinity of the lower end portions of the fibrous members 22*a*, in other words near their bases).

What is claimed is:

1. A developer supply device, comprising:

a developer carrying portion configured to supply developer in powder form to a supply target and capable of rotating in a prescribed rotational direction about a central rotational axis, the developer carrying portion having:

a roller main body having an outer surface; and a brush layer having a plurality of flexible fibrous members implanted in the outer surface, the brush layer being configured to carry the developer;

a casing having a box shaped member, the box shaped member including a developer reservoir portion therein and being formed with an opening portion along the central rotational axis, the developer reservoir portion storing the developer, the casing rotatably supporting the developer carrying portion while the brush layer is exposed externally at the opening portion and opposes the supply target; and a developer regulation portion configured to regulate an amount of the developer on the brush layer by scraping off a part of the developer temporarily carried on the brush layer, wherein the developer regulation portion includes:

a main part being fixed to the casing, having a plate portion, and extending from one end part to another end part in an extending direction; and a regulation part connected to the other end part, the regulation part entering into the brush layer by protruding toward the central rotational axis, the prescribed rotational direction at the regulation part being substantially opposite to the extending direction.

2. The developer supply device according to claim 1, wherein the developer regulation portion has a thin plate shape in a cross section taken along a plane whose normal coincides with the central rotational axis, wherein the regulation part is bent from the other end part to the developer carrying portions.

3. The developer supply device according to claim 1, wherein the main part is integrally connected to the regulation part without a seamed portion.

4. The developer supply device according to claim 3, wherein the developer regulation portion is formed with a radiused curve between the other end part and the regulation part.

* * * * *